US005339975A

United States Patent [19]

Stoner

[11] Patent Number: 5,339,975

[45] Date of Patent: Aug. 23, 1994

[54] INTERLOCKING CONTAINER STRUCTURES

[76] Inventor: Theodore A. Stoner, 2375 E. Evans Ave. #17, Denver, Colo. 80210

[21] Appl. No.: 907,227

[22] Filed: Jul. 1, 1992

Related U.S. Application Data

[63] Continuation-in-part of Ser. No. 612,186, Nov. 13, 1990, Pat. No. 5,154,295.

[51] Int. Cl.[5] ..... B65D 65/00

[52] U.S. Cl. ..... 220/4.27; 206/509

[58] Field of Search ..... 206/509, 508, 570; 220/4.27, 4.26

[56] References Cited

U.S. PATENT DOCUMENTS

| | | | |
|---|---|---|---|
| 3,250,564 | 5/1966 | Stern et al. | 206/509 |
| 3,598,271 | 8/1971 | Holley | 206/509 |
| 3,954,178 | 5/1976 | Mason, Jr. | 206/509 |
| 4,793,491 | 12/1988 | Wolf et al. | 206/509 |
| 4,981,214 | 1/1991 | Rojas | 206/509 |
| 5,150,804 | 9/1992 | Blanchet et al. | 206/509 |

*Primary Examiner*—Joseph Man-Fu Moy

[57] ABSTRACT

This invention is directed towards a means and method for interconnecting containers into structures, such as toys, displays or furniture as well as to provide packaging alternatives. The invention particularly relates to modifying a conventional sixpack of beverage cans so as to form the aforesaid structures without the use of additional components. Beverage cans are specifically utilized as said containers. The containers themselves have been modified such that they may be fastened together in a vertical manner without requiring any collars or other types of independent connecting means. "Connectors" have been provided for connecting the cans together in a side by side relationship. The interconnected containers form functional or promotional structures or a combination thereof as well as providing for packaging alternatives. Consequently, this serves as both a conservation and marketing aid.

4 Claims, 6 Drawing Sheets

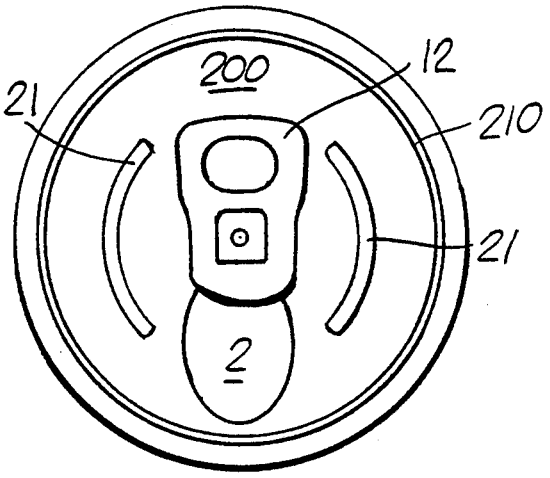
FIG.14
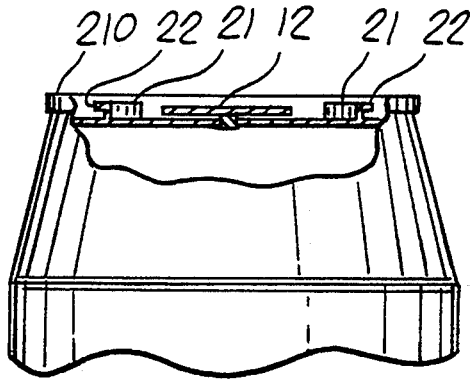
FIG.15
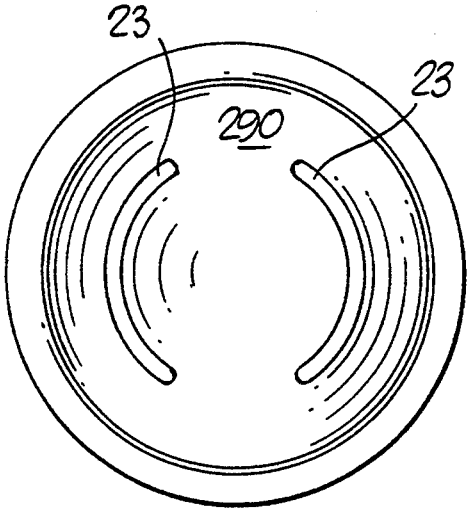
FIG.16
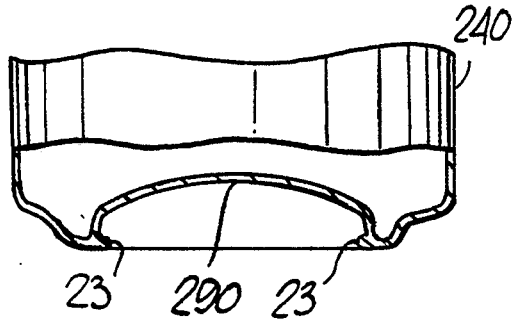
FIG.17
FIG.18
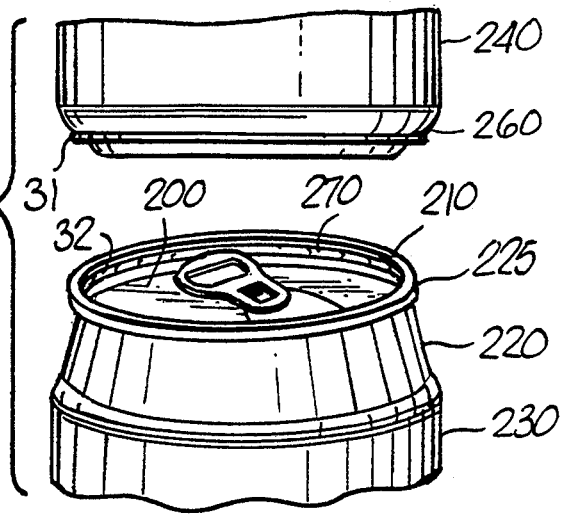

INTERLOCKING CONTAINER STRUCTURES

BACKGROUND OF THE INVENTION

This application is a continuation-in-part of Ser. No. 07/612,186 filed Nov. 13, 1990 by the same inventor, now U.S. Pat. No. 5,154,295.

Field of the Invention

This invention relates to a system for interconnecting containers, such as beverage cans; into structures, such as toys, displays and furniture, as well as to provide packaging alternatives. The invention more particularly relates to modifying a conventional six-pack of beverage cans so as to form the aforesaid structures without the use of additional components, all of which consequently serves as both a conservation and marketing aid.

STATEMENT OF THE PROBLEM

In this day and age, there has been much emphasis placed upon the need for recycling as a means for conserving our depleting natural resources as well as waste management. This recycling has encompassed everything from paper products, plastic, glass and metal of all types, Including the recycling of aluminum beverage cans. When Said beverage cans are recycled, they are melted, purified and then remolded into other shapes or containers. This process is expensive and requires extensive machinery in order to accomplish the recycling procedure. There thus exists the need for a means for recycling beverage containers without requiring a change in their physical state. The present Invention is directed towards this recycling purpose. Namely, conventional beverage cans are modified at the point of manufacture such that the empty cans may be recycled into a new use, without using additional structural components, wherein the cans and the packaging material can be readily used as a modular building components for children and others to create toys, displays, furniture, etc. By adding value to the empty beverage cans, this should also discourage the littering of the empty cans. Another need exists for retailers to be able to construct stable, three dimensional displays in order to advertise the product found in the can, when the cans are filled. Finally, the need exists for stable, interlocking stacking in packaging to create packaging alternatives.

RESULTS OF A PATENTABILITY SEARCH

In the prior art search conducted, directed to the above need, patents were discovered that allow a container to be recycled into a type of building block—the patents to Moore and Stolte The patent to Moore (U.S. Pat. No. 2,613,747) discloses another container specifically fashioned as a stackable, toy block. As shown, Moore utilizes a specifically designed food container that also served to form children's toys, furniture etc. Likewise, Stolte (U.S. Pat. No. 2,631,747,)discloses another container specifically fashioned as a stackable, toy block. No means for attaching the containers together in a horizontal manner nave been provided in Stolte.

Regarding the secondary need using filled containers to form stable advertising displays and packaging alternatives, most grocery stores regularly simply stack food and beverage containers without using any forms of interconnections. However, these stacked cans are unstable due to the lack of the presence of a mating connection either horizontally or vertically present between each can. To overcome this instability, collars have been provided to add to the stability as shown in the prior art.

For example, in the patent to Itoh (U.S. Pat. No. 4,582,447) a collar is provided for interconnecting cans to form a display. Kander (U.S. Pat. No. 3,815,281) utilizes flexible, resilient plastic caps on beverage cans to create toy structures. The patent to Schenkman (U.S. Pat. No. 4,593,818) pertains to a collar device made of moldable elastic material and used for engaging the tops and bottoms of cans to form a stack of cans. Likewise, the patent to Wilkins (U.S. Pat. No. 2,292,310) discloses another collar or clamping band that is used to support one can upon another. izumi (U.S. Pat. No. 3,422,564), Freedman (U.S. Pat. No. 4,170,082) and Graham (U.S. Pat. No. 2,090,477) each disclose separate interconnectable collars utilized to join either tubular or cylindrical elements together in both the vertical and horizontal dimensions. The tubular or cylindrical elements of all of the above cited references have however not been modified themselves in any manner whatsoever which is a crucial feature of the Applicant's claimed invention in that separate connecting means are not required in order for the cans to be securely fastened together in the vertical direction. That is Applicant's containers can be stacked by means formed as an integral part of the container.

Finally, the patent to Marrits (U.S. Pat. No. 1,771,264) discloses a series of stacked collars that are employed to form a stable structure of filled food cans. This patent is the most removed from the Applicant's invention as it necessitates the use of central support post 6.

Containers have also been modified to form a more secure stacked structure. Wells et al (U.S. Pat. No. 4,003,491) sets forth modifications to the top and bottom rim structures of containers of beverage containers to enable two adjacent containers to be secured together. Only FIG. 9 of Wells et al discloses vertical connections. The Wells reference, however does not teach securely locking the containers together to prevent accidental separation.

Greco (US. Pat. No. 2,753,077) discloses cans having sawtooth edges that mesh together when one can is stacked upon another. This sawtooth configuration makes these cans dangerous for use by children. The patent to Zak (U.S. Pat. No. 4,690,271) discloses threaded containers that may be secured together in a vertical stack (see FIG. 4) when removed from their traveling case.

The patent. to Galer (U.S. Pat. No. 4,386,701) discloses means for stacking plastic containers. The vertically stacked containers do not lock, and can be tipped with respect to each other or separated by shifting or rotating the stacked assembly.

None of the above cited prior art however is specifically addressed to the needs of the above problem for recycling beverage cans and their "holders" into building components, i.e. providing a new use for the empty beverage can. Most of the prior art requires separate collars for any vertical stacking of cans and of those that don't, there is no teaching of the secure locking arrangement to prevent accidental separation or tipping as disclosed by applicant.

SOLUTION TO THE PROBLEM

The present invention solves both needs (i.e. enabling vertical and horizontal connections for (1) empty containers for building toys, furniture etc, and (2) filled containers for building retail displays and packaging alternatives) by modifying conventional cans and packaging material at the point of manufacture such that they are easily recycled while also providing a stable, integral vertical attaching means that allow stable, functional or promotional display structures to be constructed. In both cases the stacked containers are locked in a stable fastened manner to prevent accidental separation.

SUMMARY OF THE INVENTION

The invention is drawn to a means and method for utilizing beverage cans and plastic six-pack holders to build composite horizontal and vertical structures, as well as to provide packaging alternatives. The method comprises the steps of taking a plastic six-pack holder having three integral pairs of connectors, each of these pairs of connectors having opposed circular openings, perforating the common edges between said three pairs of connectors and separating the plastic six-pack holder into three pairs of opposed connectors by manually tearing through the perforations provided. Each circular opening provided in a connector is then forced over and about the upper lip of a beverage can such that said connector horizontally attaches two adjacent cans together. One of the openings in a second connector is the forced about the upper lip of one of the beverage cans already attached to the other while the second in the second connector is then forced about the upper lip of a third can such that three beverage cans are now joined horizontally together to form an array.

The top and bottom ends of each can have also been provided with formed integral interconnecting and interlocking means such that the bottom of one beverage can may be selectively interconnected and locked in a secure fastened manner to the top of an adjacent can to form a vertically interconnected and interlocked arrangement of stacked cans.

Thus, a beverage can is then vertically attached to the above cited horizontal array of beverage cans by placing the bottom end of one can on top of the top end of an adjacent can, aligning and the joining together the interconnecting and Interlocking means. The cans are firmly interlocked to prevent accidental separation. The above steps are repeated until a composite horizontal and vertical structure of the desired height and shape is constructed.

The features of novelty which characterize this invention are pointed out with particularity in the claims annexed to and forming a part of the specification. The invention itself, however, both as to its organization and manner of operation, may be best understood upon reference to the following description taken in connection with the accompanying drawings, the figures of which are described briefly as follows.

DESCRIPTION OF THE DRAWING

FIG. 14 is a top view of a can used in another alternative embodiment.

FIG. 15 is a partially cross-sectional view of the top portion of the can of FIG. 14

FIG. 16 is a bottom view of the can of the embodiment of FIGS. 14 and 15.

FIG. 17 is a partially cross-sectional view of the bottom portion of the can of FIG. 16.

FIG. 18 Is a view illustrating the interlocking means of another alternative embodiment.

DETAILED DESCRIPTION OF THE INVENTION

GENERAL APPLICATIONS

Figure 1:
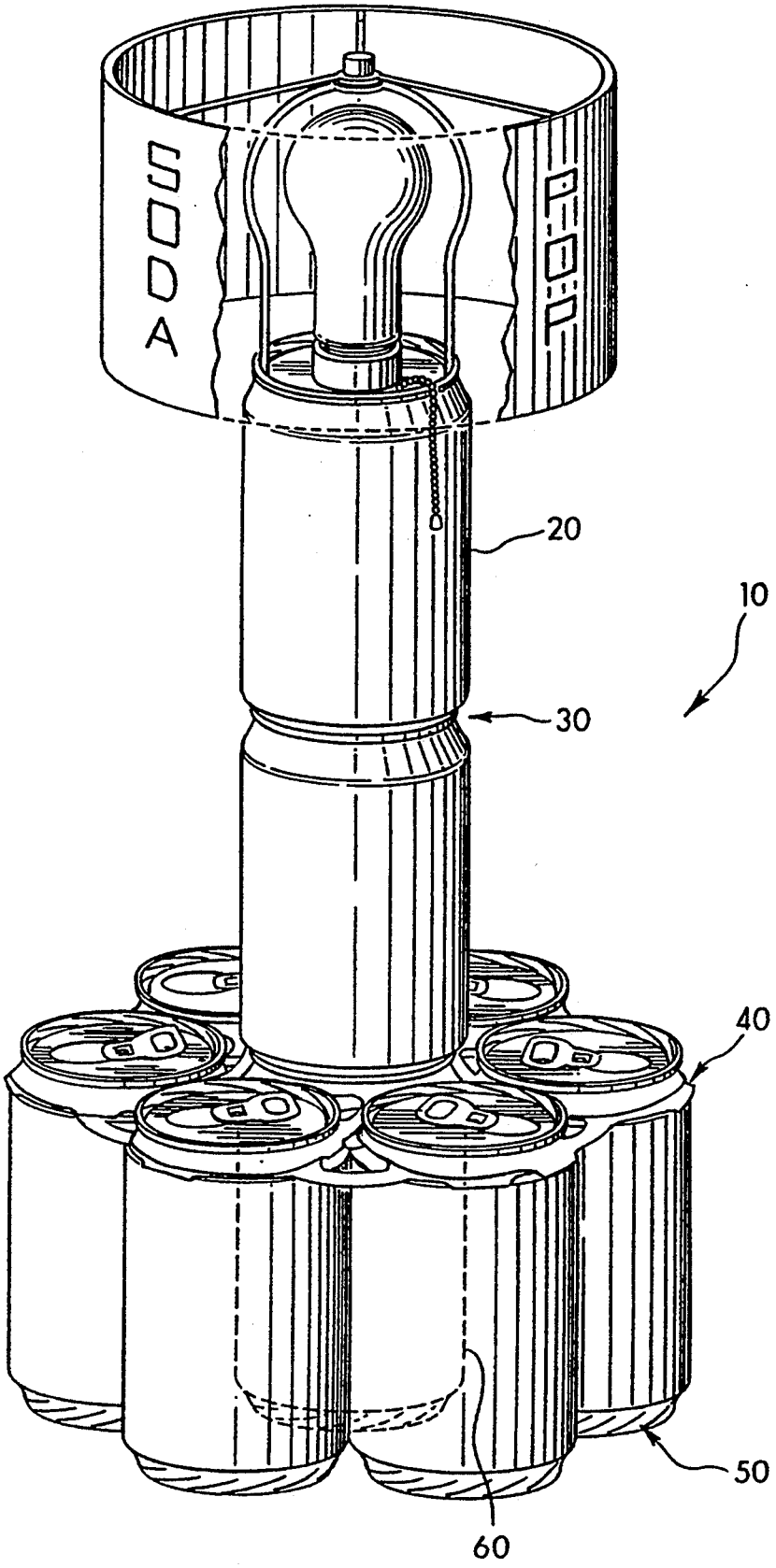
FIG. 1 is a perspective view of a composite structure made out of interlocked beverage cans.

FIG. 1 illustrates a particular application of this invention, namely, a perspective view of a composite structure 10 made out of interlocked filled and empty beverage cans 20. In this instance, the beverage cans 20 are horizontally attached together with connectors 40 to form a circular array that serves as a base for the illustrated lamp structure. Then, cans 20 are vertically interlocked together (as shown at vertical junction 30) with the center can 60 of the array (as shown in dotted lines in FIG. 1) to form the stem of the tamp. As shown, interlocking means 50 are provided on the base of each can to permit the interlocking of containers 20 together in the vertical direction. The center cans are empty to allow for the passage of electrical wiring therethrough while the horizontal cans are filled to provide a weighted base. By utilizing the interlocking beverage cans 20 and connectors 40, a functional or promotional display structure 10 has thus been assembled. The interlocking feature of the cans prevents the structure from tipping or separating accidentally.

The interlocking beverage cans of the invention may be employed to make any number of structures either having a promotional or functional utility or both. For instance, interlocking beverage cans may be employed to make a lamp, as illustrated in FIG. 1, a piece of furniture such as a desk or a toy chest or they may even be utilized as a toy building block structure which may be played with by children. In addition, the cans may be assembled into an attention getting, promotional display that has no specific functional utility but is constructed merely as an art form of strictly as an advertising device. The cans 20 may be selectively left filled or empty—although most applications (other than for displays) will use empty cans. Packaging alternatives are also created. For example, a twelve (12) pack now can be packaged six (6) cans on op of six (6) cans with no case enclosure and still stay interconnected the interlocking means of this invention. Packaging alternatives, by the number and design of cans, essentially become infinite.

As will be appreciated in the following, conventional beverage cans are modified at the point of manufacture so as to enable retail establishments to construct any type of three dimensional display in order to advertise the product found in the can. Furthermore, the empty cans may be recycled into a new use wherein the cans and the packaging material can be readily used as modular building components for children and others to create toys, displays, furniture, etc.

DEFINITION OF BEVERAGE CONTAINER COMPONENTS

Figure 2:
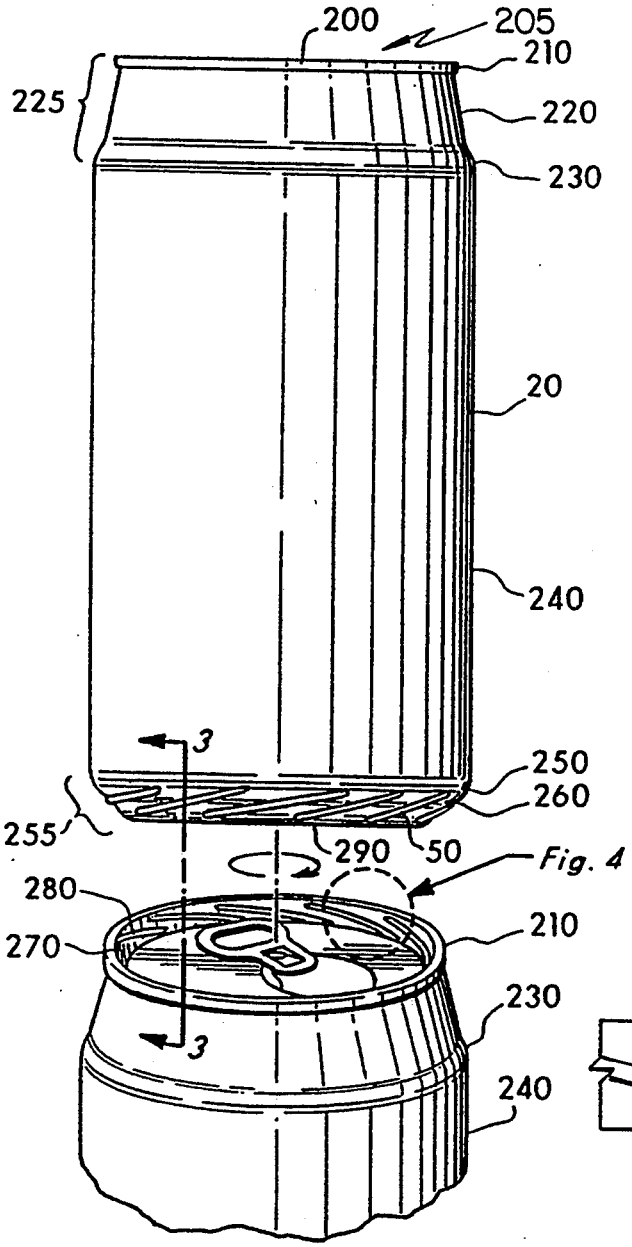
FIG. 2 is a view showing an interlocking means provided on the tops and bottoms of each can.
Figure 3:
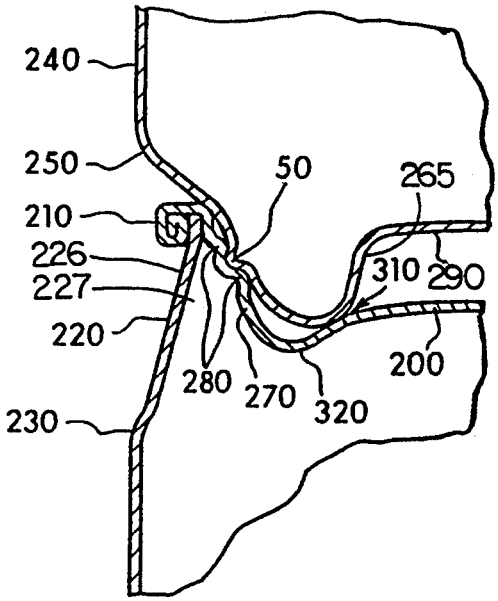
FIG. 3 is a blown-up, sectional view taken on line 3—3 of FIG. 2 that illustrates how an interlocking means provided on the tops and bottoms of each can interact with one another.

Before discussing the features of the invention in detail, it is necessary to define the components of a typical prior art beverage container, as shown in FIGS. 2 and 3, that will be modified in accordance with this invention. This invention is directed towards a container, for example, a beverage can 20 (as illustrated in FIG. 2), comprised of cylindrical, hollow body 240 arranged around a longitudinal axis having a top 200 and a bottom 290 that close and seal said hollow body. The cylindrical, hollow body 240 is comprised of an upper section 220 that leads to the lip or rim 210 of said container, a uniform cylindrical body 240 and lower nesting section 260 or bottom portion joins to the bottom end 290 of the container 20.

The upper section 225 of the can 20 comprises a first shoulder 230 attached to the cylindrical body 240 and joined at its upper end to a tapering neck 220 that in turn terminates in the upper rim 210 of the container 20. An upper perimeter flange is shown at 227 having an outer wall 226 formed from said upper section 220, an inner wall 270 and includes rim 210. The flange 227 determines the outer perimeter of the top portion 205 of the can.

The lower nesting section 255 or bottom portion of said can 20 comprises a second shoulder 250 attached to the body 240 on its upper end and to an inwardly tapering peripheral wall 260 on it's lower end. The inwardly tapering peripheral wall 260 extends downwardly an appreciable distance below said second shoulder 250 to the point at which it terminates in a continuous, peripheral foot 310 (as illustrated in FIG. 3) which forms the bottom support for said container. The inwardly tapering peripheral wall 260 forms the outer wall of the peripheral foot. The inner peripheral wall of the foot is shown at 265.

As Shown in FIG. 3, the top end 200 of the top portion 205 of the container 20 is slightly convex in cross-section with a peripheral groove 320 positioned directly within and adjacent to the inner wall 270 of the peripheral flange 227 that leads to the upper lip or rim 210 of the container.

The bottom 290 is concave in construction with said peripheral foot 310 forming the perimeter thereof. It is spaced inwardly from the outer perimeter of said container and sized such that said peripheral foot 310 substantially seats within the peripheral groove 320 provided on the top end 200 of another, adjacently positioned container. Conventionally, beverage cans are designed to "stack" wherein the peripheral foot 310 of the upper can nests in the peripheral groove 320 of the lower can. Each of the above features are old well-known in the beverage can art with the patentable features being the following modifications made to said beverage containers. It is to be expressly understood that while conventional beverage cans are shown in the drawings, that the teachings of the present invention can be adopted to other stackable containers.

INTEGRAL VERTICAL CONNECTIONS OF PRESENT INVENTION

Figure 4:
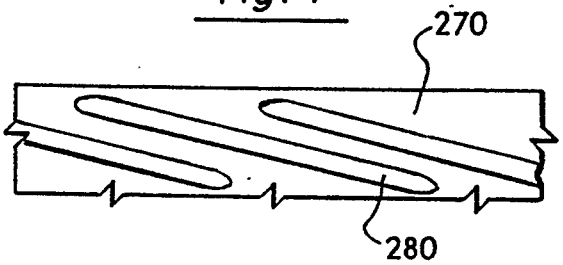
FIG. 4 is an enlarged view of an interlocking means, or threads, provided on each can.

Interlocking means (as Illustrated In FIGS. 2–5) are provided on the top portions 205 and bottom portions 255 of each can 20 for vertically locking two stacked cans together. As shown in FIG. 2, the bottom of the can is provided with integral interlocking means 50, i.e. spiraling ribs or threads, on the inwardly tapering peripheral outer wall of the peripheral foot 260 that extends below the second shoulder 250 on said can 20. The top portion 205 of each can has correspondingly been provided with interlocking means 280 on the inner wall 270 of the upstanding peripheral flange 227 that leads to the upper lip or rim 210 of said can 20. Said interlocking means provided on the base of the can and the upper end of each can have the same dimensions and pitch such that said containers 20 may be vertically connected together in a stack to form a composite structure 10. Each of the interlocking means are spaced such that the interlocking means 50 on the base of one container may laterally enter and be retained between two adjacent interlocking means 280 provided on the top portion 205 of another adjacent container. As shown in FIG. 4, one particular type of interlocking means provided on the inner flange wall 270 of each can 20 are spiraling ribs or threads 280 that have been employed as an interlocking means.

As shown in FIG. 3, The threads 50 and 280 are "formed" in the walls of the container when the overall configuration of the container is being formed during manufacture of the container. Hence, the molds used to form the inner wall 270 of the 227 peripheral flange and the peripheral wall 260 can be easily modified to form the desired interlocking thread structures 50 and 280. It is also to be expressly understood that beads of metal (such as, e.g., solder) could be deposited or otherwise placed in regions 260 and 270 to form interlocking threads.

Figure 5:
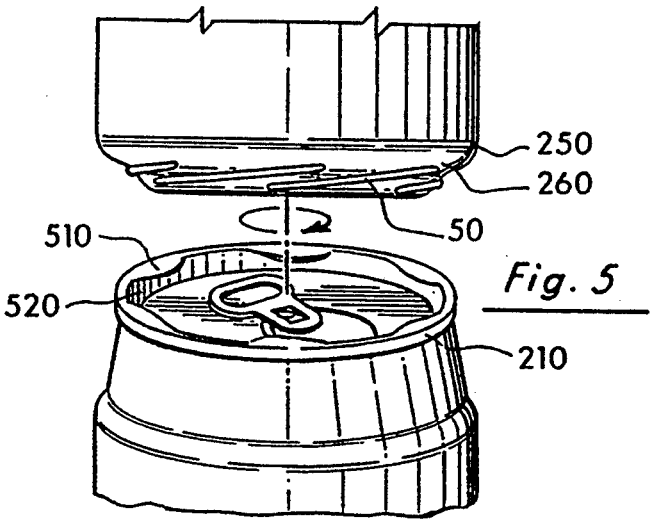
FIG. 5 is a view illustrating an alternate type of interacting means provided on the upper lip of the beverage can.

An alternate type of interlocking means provided on the upper lip of the can are illustrated in FIG. 5. In this embodiment, the lip or rim 210 of the beverage can 20 has been provided with a plurality of equally spaced semi-circular protrubances 510 extending in a axially inward directions from the perimeter surface. Beneath these semi-circular protrubances, a continuous slot 520 has been provided for receiving the interlocking means 50, i.e. threads, ribs or lugs, that have been provided on the inwardly tapering wall or outer perimeter foot wall 260 of the lower section of the can. Two adjacent cans of this type are vertically locked together by inserting the interlocking means 50, provided on the lower tapering wall or outer perimeter foot wall 260 of a can 20, between the protrubances 510 and the rotating said cans 20 in alternate direction such that the interlocking means 50 retainingly engaged by the protrubances 510 provided on the adjacent container.

From the above two embodiments (of many possibilities), it is clear that interconnecting means can be formed in the upper section 225 and in the lower nesting section 255 of each container to vertically interlock stacked containers together. Whatever the interlocking means,it should provide a locked, secured connection to prevent accidental tipping or separation of the containers. The interlocking means provides complimentary retaining engagement between adjacent cans.

HORIZONTAL CONNECTIONS OF THE PRESENT INVENTION

Figure 6:
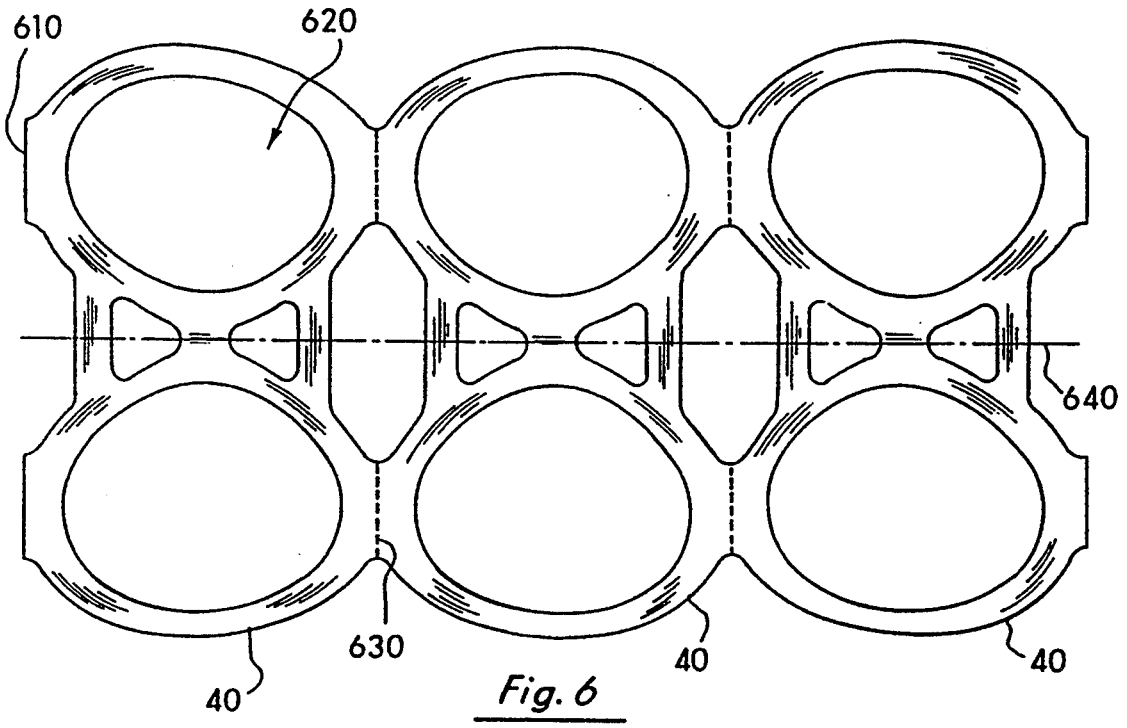
FIG. 6 is a view illustrating the typical six-pack holder provided with perforations therein.
Figure 8:
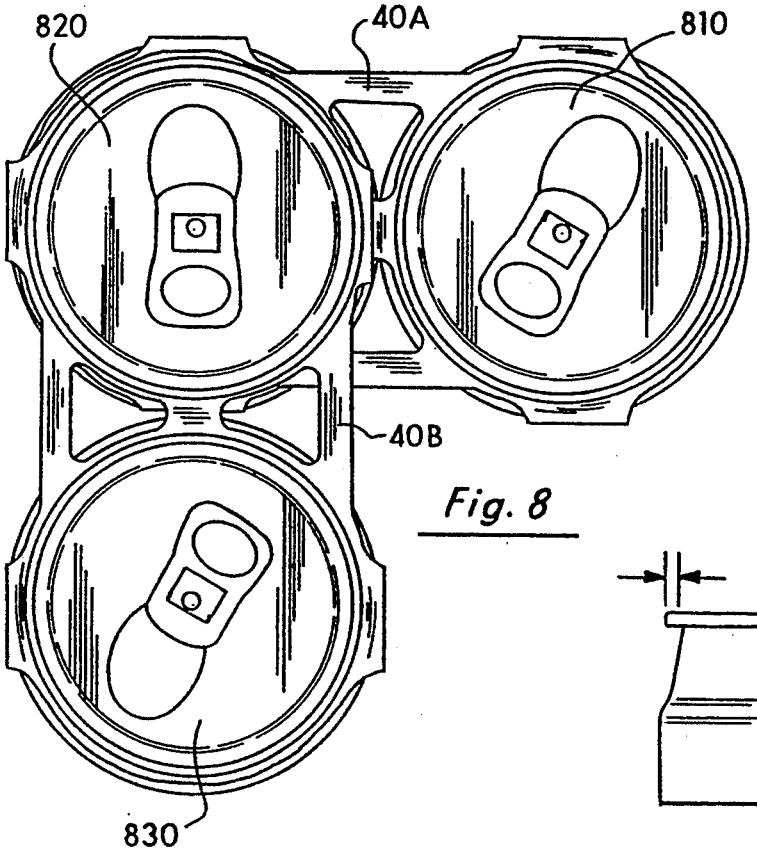
FIG. 8 is a top view showing how the beverage cans are horizontally connected together using the connectors made from a six pack holder.
Figure 7:
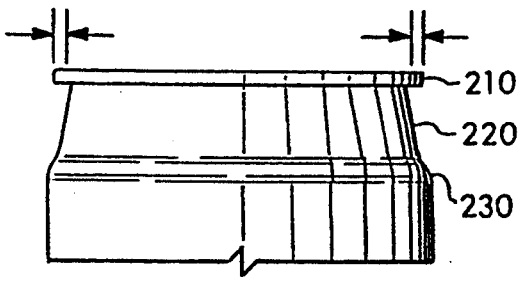
FIG. 7 is a view of the tip of a beverage can showing the enlarged peripheral section.

As stated previously, the beverage cans may also be locked together in the horizontal direction (as illustrated in FIGS. 6–8). This is achieved by employing connectors 40 made from a typical six-pack holder 610 from which the horizontal connecting means are made. The plastic six-pack holder 610 is conventionally comprised of a planar plastic element having three integral pairs of connectors 40, each of said pairs having opposed circular openings 620 sized such that each opening fits tightly over and about the upper lip or rim 210 of a beverage can 20. The common edges between said three pairs of connectors 40 are perforated 630 such that the plastic six-pack holder 610 may be separated into three pairs of opposed connectors 40 by manually tearing through the perforations 630 provided. It It should also be noted that if the plastic six-pack 610 is not provided with perforations 630 then the connectors 40 may be separated from each other by cutting them apart. For example, rather that provided perforations, dotted lines may be printed on the package as a guide for cutting In order for the beverage cans 20 to accommodate the connectors 40, the lip or rim 210 of each beverage can 20 must be enlarged as show in FIG. 7. This enlarged peripheral section rim, or lip 210, is required in order to retain more than one connector 40 that is forced over the lip or rim of said container. The typical lip or rim 210 provided on the upper container is only deep and wide enough to retain one or two connecters 40 in position thereover. Therefore, in order to accommodate the multiple connectors that are forced over and about the upper lip or rim of a container when forming a composite structure, this perimeter lip or rim 210 must be enlarged during manufacture of the container as shown in FIG. 7.

While FIGS. 6 and 8 represent a preferred embodiment, it is to be understood that the Six-pack holder 610 may also be perforated or cut through the middle 640 to provide three horizontal connections or even left uncut, in full. The present invention is not limited o the pattern of cutting. It is to be expressly understood that under the teachings of the present invention modifications could be made to the plastic six-pack holder 610 of FIG. 6 wherein the materials or the dimensional components of the edges of the circular opening 620 could be varied or modified to provide additional structural strength or engaging capabilities under the teachings of the present invention. For example, the thickness of the plastic element could be made thicker to provide more structural strength. Furthermore, color could also be added.

METHOD OF USE

The method for assembling multiple beverage cans together by using connectors to form a composite structure is illustrated in FIG. 8. As stated above, the integral, plastic six-pack holder 610 is separated into three separate pairs of opposed connectors 40 by manually tearing through the perforations provided on their common edges 630. A single connector 40A is then used to horizontally connect two cans 810, 820 together by forcing each circular opening 620 provided in said single connector 40A over and about the upper lip 210 of a beverage can such that these two adjacent cans 810 and 820 are now connected together. Then, a circular opening of a second connector 40B is placed about the upper lip 210 of one (820) of the above beverage cans which is already attached to another (810) while the second circular opening 620 of said second connector 40B is placed about another beverage can 830 such that three beverage cans 810, 820, and 830 are now joined horizontally together to form an array of the desired shape and size. These steps are repeated until a horizontal array of the desired size and shape is formed. For example, in order to form the lamp base of FIG. 1, several connectors are employed to connect every other perimeter can to the center can with the remaining perimeter cans being attached directly to an adjacent can to form a round base support for a lamp structure. Additional cans 20 are then vertically connected to the center can 60 such that together they form a lamp structure.

It can be well appreciated that the interlocked containers (vertically and horizontally) form a building system which can be used to create building structures such as toys, furniture, displays, packaging, and many other types of structures. For example, a novel three (more or less) pack arrangement for beverage cans could be formed from three containers of the present invention vertically interlocked.

A particular advantage of the building system of the invention is that it can utilize empty beverage containers or cans and thus discourages irresponsible disposal of such containers or beverage cans.

ALTERNATIVE EMBODIMENTS

Figure 9:
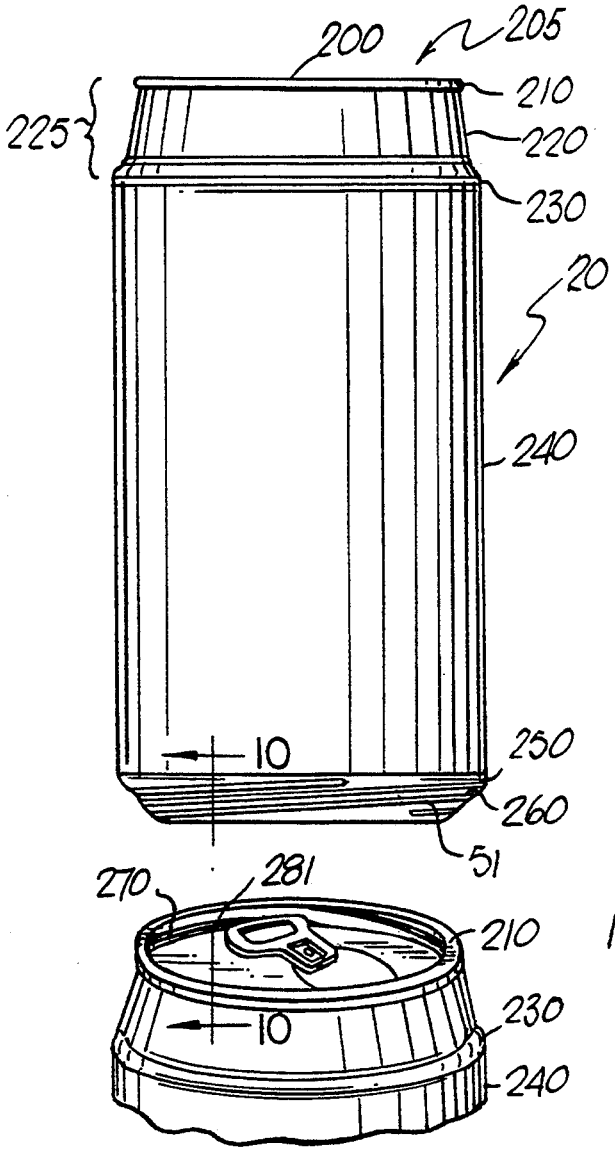
FIG. 9 is a view of an alternative embodiment showing the interlocking means provided on the tops and bottoms of each can.

FIG. 9 illustrates an alternative embodiment of the interlocking means for vertical stacking of the instant invention. It is noted that in the embodiment of FIG. 9 as well as the previous embodiments for vertical stacking, the secure, locked fastening is achieved by turning one can with respect to he can to which it is attached. This allows the upstanding ribs forming the screw thread connections to engage and provide a locked and secured connection.

Figure 10:
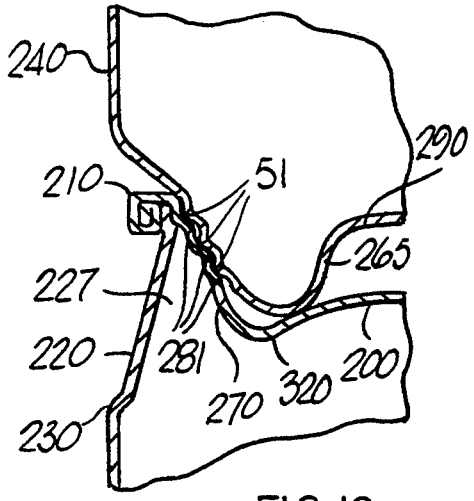
FIG. 10 is a blown-up sectional view taken on line 10—10 of FIG. 9.

In FIGS. 9 and 10 the basic can configuration is the same as that of the embodiment of FIG. 1. The difference being that a continuous screw thread or upstanding rib 51 s used instead of the broken screw thread 50, and a continuous mating screw thread 281 is used instead of the broken screw threads 280.

It is further contemplated by the instant invention that any configuration of screw thread or mating upstanding rib can be used as long as a mating, locking arrangement is achieved.

Figure 11:
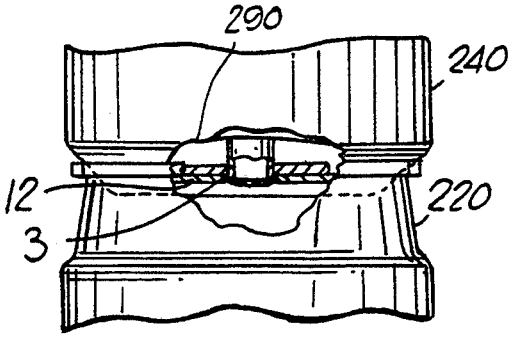
FIG. 11 is a cut away cross-sectional view of the interlocking engagement of an alternative embodiment.
Figure 12:
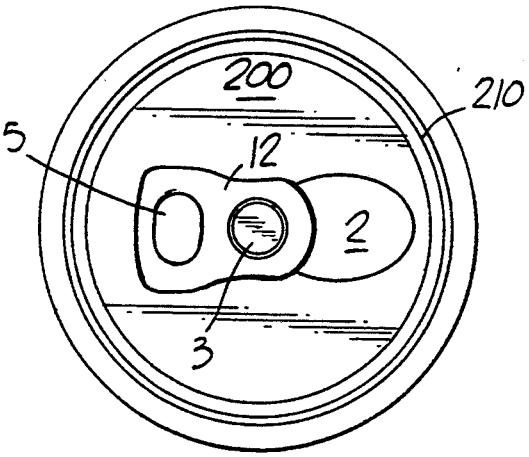
FIG. 12 is a top view of a can used In the embodiment of FIG. 11
Figure 13:
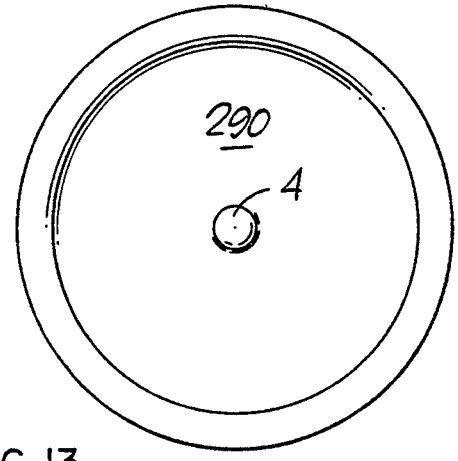
FIG. 13 is a bottom view of a can used In the embodiment of FIG. 11.

FIGS. 11, 12, and 13 are directed to an alternative embodiment for interlocking adjacent cans for vertical stacking. The embodiment of these Figures may include screw threads, though such are not necessary to the mating configuration. Thus it is possible using the embodiment of these Figures to provide a secure, stable, locking configuration without turning one can to be attached with respect to the can to which it is to be connected.

The embodiment of the Figures utilizes a stay-on type tab 12 as is commonly found on beverage cans. The tab 12 is fixed to the top portion 200 of the can, and is used to bend a piece of the top 200 to provide access opening 2 as is well known. The tab 12 of the instant invention is molded with two apertures 3 and 5.

The bottom of the can 290 is provided with a protrusion 4 located to snugly fit through aperture 3 to provide aligned stacking. Protrusion 4 is sized to fit so snugly in aperture 3 that a secure and stable locked arrangement is achieved. A snap-in and out interlocking means can also be used. Alternatively, the protrusion 4 can be provided with screw threads in the desired configuration to mate with mating screw threads in aperture 3.

An additional alternative embodiment is shown in FIGS. 14, 15, 16, and 17. The top of the can includes upstanding ribs 21 having lip portions 22. The ribs are located between the stay-on type tab 12 and the perimeter lip or rim 210.

The bottom of the can 290 includes protrusions 23. The protrusions are located to fit under lips 22 of an adjacent can when the cans are turned with respect to each other to mate the ribs 21 and the protrusions 23.

An alternative embodiment for vertical stacking is shown in FIG. 18. This embodiment does not require the cans to be turned with respect to each other to be attached. The outer peripheral wall 260 of the can bottom portion includes a continuous rib or bead 31. The rib 31 can be formed integral with the can, or it can be formed of rubber or other resilient material, and then attached to the can. The top portion 205 of the can includes a continuous groove 32 located in the inner perimeter wall 270 of the peripheral flange 227. The groove 32 is sized to receive the rib 31 in a snug and locked arrangement. After rib 31 is forcefully seated in the groove 32 of an adjacent can or container, the cans or containers are locked in a secure and stable manner o prevent tipping.

Figure 19:
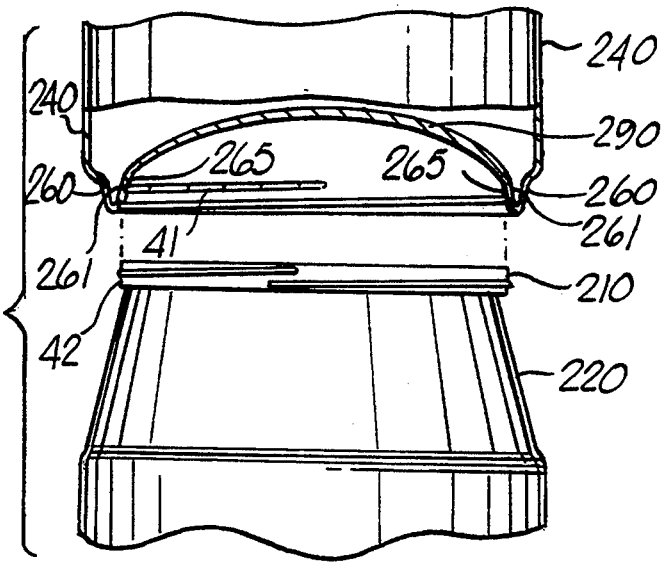
FIG. 19 is a view illustrating the interlocking means of an additional alternative embodiment.

FIG. 19 illustrates another embodiment for vertical stacking utilizing screw threads or mating ribs. The ribs 41 to be mated are located on the inside wall 265 of he peripheral foot 261, and on the outside wall 271 of he peripheral flange. It is understood however that the ribs or threads on the top portion of the container can be located anywhere on the top section including on rim 210, to accommodate a properly sized peripheral foot. As shown in the Figure, the screw thread 41 for the bottom of the container is located on the inner wall 265 of the peripheral foot. The screw thread 42 for the top of the container is located on the outer wall of the peripheral flange 225. The screw threads or upstanding ribs 41 and 42 for this embodiment can be continuous, broken, or any other configuration to mate with each other. It is important, however, that they be of such a configuration to insure a locked and secure fastening to prevent accidental tipping of he vertically sacked cans.

In conjunction with the extended lip of FIG. 7, a snap-on interlocking means can be used with the nesting relationship of FIG. 19.

Figure 20:
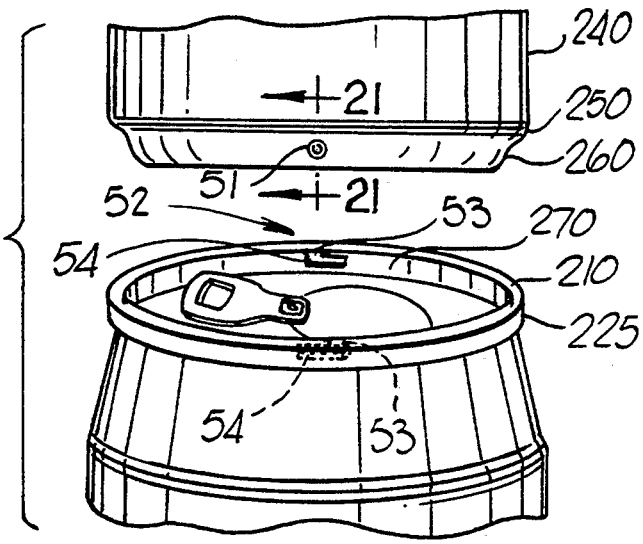
FIG. 20 is a view illustrating a further additional embodiment.
Figure 21:
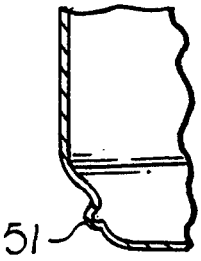
FIG. 21 is a cross-sectional view taken along line 21 of FIG. 20.

FIGS. 20 and 21 illustrate another embodiment which achieves mating and locking engagement by turning one can with reference to the other can to which it is to be attached. The interlocking means includes a protrusion 51 on the outer peripheral wall of the bottom of the can. The protrusion 51 can be formed integrally with the can by molding or it can be attached as a bead of metal. The use of an integrally molded protrusion is preferable. The top of the can includes a buoyant slot in the peripheral flange of the top of the can, The buoyant slot includes an entry portion 53 and a horizontal portion 54 for locking. The entry portion does not, however, break the lip or rim 210 of the can, so that a smooth rim can be maintained for drinking. The entry portion 53 lies in the inner wall 270 of the peripheral flange 227 below the rim 210. The inner wall 270 of the flange is inclined to allow access to the bayonet slot. In operation, protrusion 51 enters the entry portion 53 of the slot, and then the cans are turned relative to each other to allow the protrusion 51 to seat and lock in the horizontal portion 54. Any desired number of buoyant slots 52 and corresponding protrusions 51 can be used, The buoyant slot arrangement allows two cans to be vertically stacked in a locked and secure manner.

Figure 22:
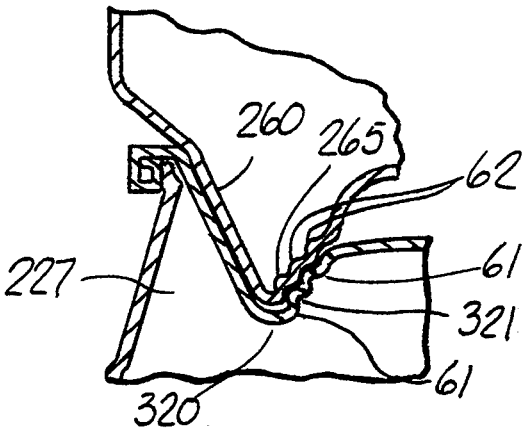
FIG. 22 is across-sectional view of an additional embodiment.

An alternative embodiment using a different location for screw threads or mating ribs Is shown in FIG. 22. The top of the can 200 is molded or formed so as to allow screw threads or raised ribs 61 on the interior wall 321 of the groove 320. Corresponding ribs 62 are provided on the interior wall of the peripheral foot, The outer tapered wall 260 seats against the peripheral flange 227 of a corresponding can when two adjacent cans are attached. It is noted the screw threads may be continuous or broken or any other mating configuration.

In the previous embodiments it is contemplated that the nesting relationship can be inverted. It is also contemplated that the interlocking means and their locations can be varied.

Although a typical aluminum type beverage container has been described with reference to the present invention it is noted that other materials such as well known types of plastic can also be used.

While preferred embodiments of the present Invention have been shown, it is to be expressly understood that modifications and changes may be made thereto, and that the present invention is set forth in the following claims.

I claim:

1. A beverage container having a hollow cylindrical body comprising a top portion, a bottom portion, and a main body having a longitudinal axis, said top portion further comprising a perimeter flange having an outer wall facing outward of said container, a top rim, and an inner wall facing inward of said container toward said longitudinal axis, said inner and outer walls being connected to said top rim, said top portion further comprising a first integral interlocking means located on said top portion between said longitudinal axis and said top rim, and movable means fixed to said top portion for accessing the interior of the beverage container and wherein said first interlocking means is on said movable accessing means, said bottom portion comprising second integral interlocking means for mating and locking with said first interlocking means of the top portion of a similar container wherein adjacent containers can be stacked along the longitudinal axis of the main body portion with said first interlocking means mating and locking with said second interlocking means to securely fasten, attach and lock together the containers in a vertical arrangement to prevent tipping and separation of the interlocked containers.

2. The beverage container of claim 1 wherein said first interlocking means comprises an aperture on said movable accessing means, and said second interlocking means comprises a protrusion on said bottom portion of the container for mating and locking with said aperture.

3. The beverage container of claim 2 wherein said aperture has at least one first screw thread and said protrusion has at least one second screw thread, and wherein said first and second screw threads mate and lock.

4. The beverage container of claim 1 wherein said beverage container is a beverage can.

* * * * *